United States Patent [19]

Juergens et al.

[11] 4,085,011

[45] Apr. 18, 1978

[54] PROCESS FOR THE PRODUCTION OF A THIN-FILM CIRCUIT

[75] Inventors: Wilfried Juergens; Manfred Roschy, both of Munich; Alois Schauer, Gruenwald, all of Germany

[73] Assignee: Siemens Aktiengesellschaft, Berlin & Munich, Germany

[21] Appl. No.: 732,987

[22] Filed: Oct. 15, 1976

[30] Foreign Application Priority Data

Oct. 17, 1975 Germany ..... 2546675

[51] Int. Cl.[2] ..... C25D 5/50; C23C 15/00

[52] U.S. Cl. ..... 204/37 R; 204/38 A; 204/192 SP; 204/192 F; 323/78; 333/70 CR; 338/308; 361/274

[58] Field of Search ..... 204/38 A, 37 R, 192 SP, 204/192 F; 29/25.42, 620, 624, 625; 317/258, 256; 338/308; 427/101; 323/78; 333/70 CR

[56] References Cited

U.S. PATENT DOCUMENTS

| | | | |
|---|---|---|---|
| 3,607,679 | 9/1971 | Melroy et al. | 204/15 |
| 3,627,577 | 12/1971 | Steidel | 204/192 F X |
| 3,718,565 | 2/1973 | Pelletier | 204/192 SP |
| 3,738,919 | 6/1973 | Chilton et al. | 204/37 R |
| 3,955,039 | 5/1976 | Roschy et al. | 428/457 |
| 4,020,222 | 4/1977 | Kausche et al. | 428/209 |

OTHER PUBLICATIONS

R. W. Berry et al., "Tantalum Printed Capacitors", *Proc. IRE,* June, 1959, pp. 1070–1075.

*Primary Examiner*—Aaron Weisstuch

*Attorney, Agent, or Firm*—Hill, Gross, Simpson, Van Santen, Steadman, Chiara & Simpson

[57] ABSTRACT

A thin-film circuit which includes temperature-compensated RC elements consisting of an AlTa alloy layer having approximately 3–17 at % tantalum in aluminum, which is sputtered or vapor deposited onto a non-conductive substrate, is produced by a process in which the AlTa alloy layer is deposited in an operative, reactive gas mixture, containing at least one of the gases $O_2$, $CO_2$, and $N_2$ and the $TC_R$ value is established by the tantalum component of the alloy layer and/or partial pressure of the reactive gas, and the $TC_C$ value of the capacitors formed from the AlTa alloy layer is established by tempering to be at least approximately oppositely equal to the $TC_R$ value.

3 Claims, No Drawings

PROCESS FOR THE PRODUCTION OF A THIN-FILM CIRCUIT

BACKGROUND OF THE INVENTION

1. Field of the Invention

The invention relates to a process for the production of a thin-film circuit having temperature-compensated RC elements composed of an AlTa alloy layer with approximately 3 to 17 at% tantalum in aluminium, which is sputtered onto a non-conductive substrate.

2. Description of the Prior Art

For thin-film circuits with temperature-compensated RC elements, such as described for example in "Electron. Comp. Conf." (1969) pages 367 to 371, the previous practice was to use $\beta$-tantalum capacitors with a $TC_C$ value, i.e. with a temperature coefficient of the capacitance of approximately +200 ppm/° K and $TaO_XN_Y$ resistors with a temperature coefficient of the resistance ($TC_R$ value) of approximately −200 ppm/° K.

Recently, the development of thin-film capacitors based on AlTa with and without gas addition has gained in significance, the production of an AlTa layer with gas addition, such as described for example in German published application No. 2,356,419, being effected by reactive sputtering of an AlTa alloy containing approximately 3 to 17 at% Ta. It is seen that the thin-film capacitors constructed in this way are in many respects better than capacitors produced solely from tantalum. Thus, for capacitors based on AlTa, in comparison to the known $\beta$-tantalum capacitors mentioned in the introduction, in current-voltage curves the voltage at which twice the charging current flows is not reached until higher voltages. The yield is also considerably greater. The $TC_C$ value of the capacitors produced in this way is approximately +500 ppm/° K as can be gathered, for example, from the earlier German Patent Application No. P 24 29 434.6. Consequently, temperature-compensated RC elements require resistances having a $TC_R$ value of −500 ppm/° K which, as indicated by the above patent application and the German published application No. 2,356,419, can be produced by reactive cathode sputtering of AlTa with $O_2$ and/or $N_2$ addition, and a suitable selection of the partial pressure of this addition and a suitable Ta-component in the aluminium.

In order to be able to better compensate the changes in electric properties in individual zones of a thin-film circuit, which may occur due to different temperature influences, it is also of advantage that it is possible not only to render the different-sign temperature coefficients of R and C equal in magnitude, but also as small as possible from the point of view of absolute amount.

This can be effected extremely well with respect to the $TC_R$ value by varying the reactive gas pressure during the sputtering of an AlTa layer. The $TC_C$ value of the corresponding thin-film capacitors, on the other hand, cannot be varied, or varied only to a slight extent in this fashion. To overcome this problem, tempering experiments were consequently carried out with finished AlTa capacitors, where it was possible to displace the initial $TC_C$ value of originally +500 ppm/° K towards lower values (to approximately +300 ppm/° K), without thereby altering the $TC_R$ value. This provides the possibility of producing RC elements whose TC values are compensated even at + 300 ppm/° K.

Also, for reasons of production technology, it is desirable to use temperature-compensated RC elements with low absolute TC values. In the reactive sputtering of the AlTa basic layer it is in fact seen that layers which are sputtered with low reactive gas pressures, and thus low absolute $TC_R$ values, can be reproduced better than those having a high $TC_R$, since with an increasing partial pressure of the reactive gas the linear dependence between $TC_R$ and this gas pressure becomes increasingly exponential. Accordingly, small changes in partial pressure lead to greater $TC_R$ value fluctuations, and thus to more difficult production conditions.

SUMMARY OF THE INVENTION

The object of the present invention is to provide a process for the production of a thin-film circuit with temperature-compensated RC elements, where, for purposes of compensation, the absolute values of the temperature coefficients of R and C are to be equal and as low as possible.

DESCRIPTION OF THE PREFERRED EMBODIMENTS

In a process for the production of a thin-film circuit with temperature-compensated RC elements consisting of an AlTa-alloy layer with approximately 3–17 at% tantalum in aluminium, which is sputtered onto a non-conductive substrate, for the realization of the object, the invention provides that the tantalum-aluminium alloy layer be sputtered in an operative, reactive gas mixture containing at least one of the gases $O_2$, $CO_2$ and $N_2$ and the $TC_R$ value be set by the tantalum component of the alloy layer and/or partial pressure of the reactive gas, and that the $TC_C$ value of the capacitors formed from the aluminium-tantalum alloy layer be set by annealing at least approximately oppositely equal to the $TC_R$ value, after the dielectric of the capacitor has been formed by anodizing the layer.

If, with one of the above-mentioned gases and with a corresponding partial pressure of this gas, an AlTa alloy of the selected composition range is deposited onto a substrate in such manner that the $TC_R$ value amounts to approximately −300 ppm/° K. and if the capacitors formed from the deposited layer are, after anodizing annealed in air, e.g. for 7 hours at 250° C, the $TC_C$ value falls from +500 ppm/° K to approximately +300 ppm/° K, without the $TC_R$ value being fundamentally influenced. In this way, from a standard layer possessing a starting value of the $TC_C$ value of approximately +500 ppm/° K and a $TC_R$ value which, by an appropriate selection of the tantalum component and/or the partial pressure of the reactive gas is set at approximately −300 ppm/° K, by annealing it is possible to obtain resistors and capacitors having a $TC_R$ value of −300 ppm/° K and a $TC_C$ value of +300 ppm/° K. The partial pressure of the reactive gas amounts to approximately $5 \times 10^{-3} - 1 \times 10^{-1}$ Pa when, for example, a ring discharge plasma (600 V, 2A) process is used for the cathode sputtering. The operative gas is, for example, argon, whose partial pressure is set at approximately $1 \times 10^{-1}$ Pa, where 1 Torr = 101,325/760 Pa.

In this way, it is possible to produce thin-film circuits with temperature-compensated RC elements from one layer. The selective annealing of the conductor paths consisting of NiCrAu on a reactively sputtered AlTa alloy, as described in the earlier German Application No. P 24 29 434.6 is also possible in these networks. Investigations have also shown that there is an overall improvement in the quality of the AlTa capacitors as a result of the annealing. Thus, for example, the insulation current decreases and the current-voltage curves are improved. In a long-endurance test the annealed AlTa capacitors exhibit a smaller capacitance drift than unannealed capacitors. Capacitors made from reactively sputtered AlTa-films are also improved in their electric properties in constrast to $\beta$-tantalum capacitors as a result of the annealing.

Although we have described our invention by reference to exemplary embodiments, many changes and modifications of the invention may become apparent to those skilled in the art without departing from the spirit and scope of the invention. We therefore intend to include within the patent warranted hereon all such changes and modifications which may reasonably and properly be included within the scope of our contribution to the art.

We claim:

1. A process for producing a thin-film circuit which includes temperature-compensated RC elements which have an AlTa alloy layer of approximately 3–17 at% tantalum in aluminum, comprising the steps of:

sputtering the AlTa alloy onto a non-conductive substrate in an operative reactive gas taken from the group consisting of $O_2$, $CO_2$ and $N_2$ and mixtures thereof, the $TC_R$ value being set by the tantalum component of the alloy layer;

anodizing the layer to provide the dielectric of the capacitor; and annealing the element to adjust the $TC_C$ value which is approximately equal and opposite to the $TC_R$ value of the Alta layer.

2. A process for producing a thin-film circuit which includes temperature-compensated RC elements which have an AlTa alloy layer of approximately 3–17 at% tantalum in aluminum, comprising the steps of:

sputtering the AlTa alloy onto a non-conductive substrate in an operative reactive gas taken from the group consisting of $O_2$, $CO_2$ and $N_2$ and mixtures thereof at a pressure in the range of $3.75 \times 10^{-5}$ to $7.5 \times 10^{-4}$ Torr, the $TC_R$ value being set by the partial pressure of the reactive gas;

anodizing the layer to provide the dielectric of the capacitor; and annealing the element to adjust a $TC_C$ value which is approximately equal and opposite to the $TC_R$ value of the Alta layer.

3. A process for producing a thin-film circuit which includes temperature-compensated RC elements which have an AlTa alloy layer of approximately 3–17 at% tantalum in aluminum, comprising the steps of:

sputtering the AlTa alloy onto a non-conductive substrate in an operative reactive gas taken from the group consisting of $O_2$, $CO_2$ and $N_2$ and mixtures thereof, at a partial pressure in the range of $3.75 \times 10^{-5}$ to $7.5 \times 10^{-4}$ Torr, the $TC_R$ value being set by the tantalum component of the alloy layer and by the partial pressure of the reactive gas;

anodizing the layer to provide the dielectric of the capacitor; and annealing the element to adjust a $TC_C$ value which is approximately equal and opposite to the $TC_R$ value of the AlTa layer.

* * * * *